US006389226B1

(12) United States Patent
Neale et al.

(10) Patent No.: US 6,389,226 B1
(45) Date of Patent: May 14, 2002

(54) MODULAR TANKLESS ELECTRONIC WATER HEATER

(75) Inventors: Stephen D. Neale, Scottsdale; Randall W. Stultz, Phoenix, both of AZ (US); Andrew Hruska, Temecula, CA (US); Gary Gordon, Fountain Hills; Steven J. Onder, Scottsdale, both of AZ (US)

(73) Assignee: Envirotech Systems Worldwide, Inc., Scottsdale, AZ (US)

( * ) Notice: Subject to any disclaimer, the term of this patent is extended or adjusted under 35 U.S.C. 154(b) by 0 days.

(21) Appl. No.: 09/851,837

(22) Filed: May 9, 2001

(51) Int. Cl.[7] ..... F24H 1/10
(52) U.S. Cl. ..... 392/485; 352/491
(58) Field of Search ..... 392/485, 490, 392/491, 492, 498, 500; 22/47, 13.07

(56) References Cited

U.S. PATENT DOCUMENTS 3,586,822 A * 6/1971 Pastore ..... 219/486
4,604,515 A 8/1986 Davidson
4,692,592 A * 9/1987 Kale ..... 392/450
4,808,793 A 2/1989 Hurko
5,325,822 A 7/1994 Fernandez
5,408,578 A 4/1995 Bolivar
5,438,642 A 8/1995 Posen
5,479,558 A 12/1995 White et al.

* cited by examiner

*Primary Examiner*—Teresa Walberg
*Assistant Examiner*—Thor Campbell
(74) *Attorney, Agent, or Firm*—Jennings, Strouss & Salmon PLC; Joseph W. Mott

(57) ABSTRACT

A compact tankless water heater of modular configuration to accommodate a range of potential demands is disclosed. A heat transfer chamber is divided into subchambers, each of which may may mount more than one heating element. Notched passageways at the top of each dividing wall allow water passage between chambers, and a plurality of temperature sensors act in concert with a flow sensor and microprocessor control of the heating elements to maintain a constant set point output water temperature.

8 Claims, 3 Drawing Sheets

MODULAR TANKLESS ELECTRONIC WATER HEATER

BACKGROUND OF THE INVENTION

The present invention relates generally to the field of tankless fluid heaters. These are flow-through devices for the instantaneous heating of a fluid by passing the fluid through a chamber containing a heating element. Several versions of such an apparatus have been particularly adapted to heating water, with the objective of serving the function ordinarily performed by a standard tank-type water heater.

Tankless water heaters in general have an advantage over tank-style water heaters in that they apply energy to heat only water about to be used, rather than continually heat and reheat a stored reservoir of water. A principal challenge in tankless water heater design is that widely varying flow rate demands are present in a typical use, and ideally a constant set water temperature at the output will be available regardless of flow velocity or flow volume. Further, the bounds on flow demand in, for example, typical residences may vary widely by size of residence or size of family.

The latter problem has been addressed by modular tankless heater design, whereby one or more heating elements may be placed in contact with the moving water, according to the expected maximum flow to be serviced. The multiple elements may be in a single water chamber or in a set of chambers connected in series between cold water input and heated water output. For all such designs, it is advisable to maximize the transfer of heat to the flowing liquid by moving the liquid sequentially across the heating elements. Most inventions of this sort have disclosed a feedback mechanism, either analog, digital or microprocessor-based, to regulate the output temperature by turning off the elements when the water gets hot enough, and a flow sensor to assure that the elements operate when fluid is moving through the system, shutting off when the flow ceases.

For example, U.S. Pat. No. 5,408,578 to Bolivar discloses a tankless heater with a plurality of elongated chambers, each of which contains a heating element, water under pressure enters the first heating chamber at the bottom and fills it. A pair of ports of different sizes connect the first heating chamber with an adjacent heating chamber. The size difference allows better distribution of water to the heating elements. The design also includes an entrance chamber containing a flow control switch that activates the heating circuitry when water moves through the chamber. Hurko, U.S. Pat. No. 4,808,793 discloses a tankless electric water heater which includes an open ended folded tubular conduit having a separate metal-sheathed emersion heating element inserted into each end of the conduit. It also includes a self-regulatory heating cable, either in or wrapped around the tubular conduit, that is energized independently of the main heating elements and keeps the standing water in the chamber at a set temperature. Davidson, U.S. Pat. No. 4,604,515, discloses a chamber housing that is divided into a plurality of equal subchambers by barrier walls, with each subchamber having a heating element responsive to a separate temperature sensor.

White, U.S. Pat. No. 5,479,558, discloses a compact tankless water hater in which a single water chamber, filled from the bottom, contains four individually controlled heating elements. A pressure responsive flow switch activates circuitry which sequentially energizes the heating elements according to need. Posen, U.S. Pat. No. 5,438,642 discloses a serpentine chamber for water flow, carrying the water sequentially along in a plurality of heating elements, which can be either flat plate elements that constitute combination heating and chamber partition assemblies. Fernandez, U.S. Pat. No. 5,325,822, discloses modular units having two connected chambers, each with a heating element, that may be connected in series. Temperature sensors in the first and second chambers of each module provide signal inputs to energize each heating element of each chamber for a period of time proportional to the temperature difference between the first sensor and the desired set temperature.

SUMMARY OF THE INVENTION

The present invention comprises a compact tankless water heater capable of configuration to accommodate a range of potential demands. A rectangular heat transfer chamber is divided by a central rib wall into two subchambers. An inlet opening at the bottom of the apparatus is centered on the rib wall so that water enters and fills both subchambers simultaneously. A plurality of heating elements is mounted in the heat transfer chamber, with the preferred design capable of fitting from one to four elements, depending upon the expected demand for hot water. Thus, the same configuration may be installed whether demand requires four elements (typically a house for a family of four), or just one (such as an individual sink).

A notch passageway at the top of the central rib permits water to flow between the subehambers if one fills faster than the other. An exit chamber adjacent to the heat transfer chamber is connected at the bottom to the plumbing in the facility being serviced. A notch passageway at the top of the heat chamber wall allows water to flow across and down into the exit chamber.

A flow sensor measures the rate of water movement, and temperature sensors are placed at the water inlet, the outlet, and near the tops of the two heating chambers. With flow rate, incoming temperature and outgoing temperature as inputs, a microprocessor based controller regulates the energy to the heating elements to maintain a set point water temperature. Safety of the unit is enhanced by a mechanical thermal cut-off switch as well as protective relays that open when an over-temperature condition in the chamber is sensed.

DETAILED DESCRIPTION

Figure 1:
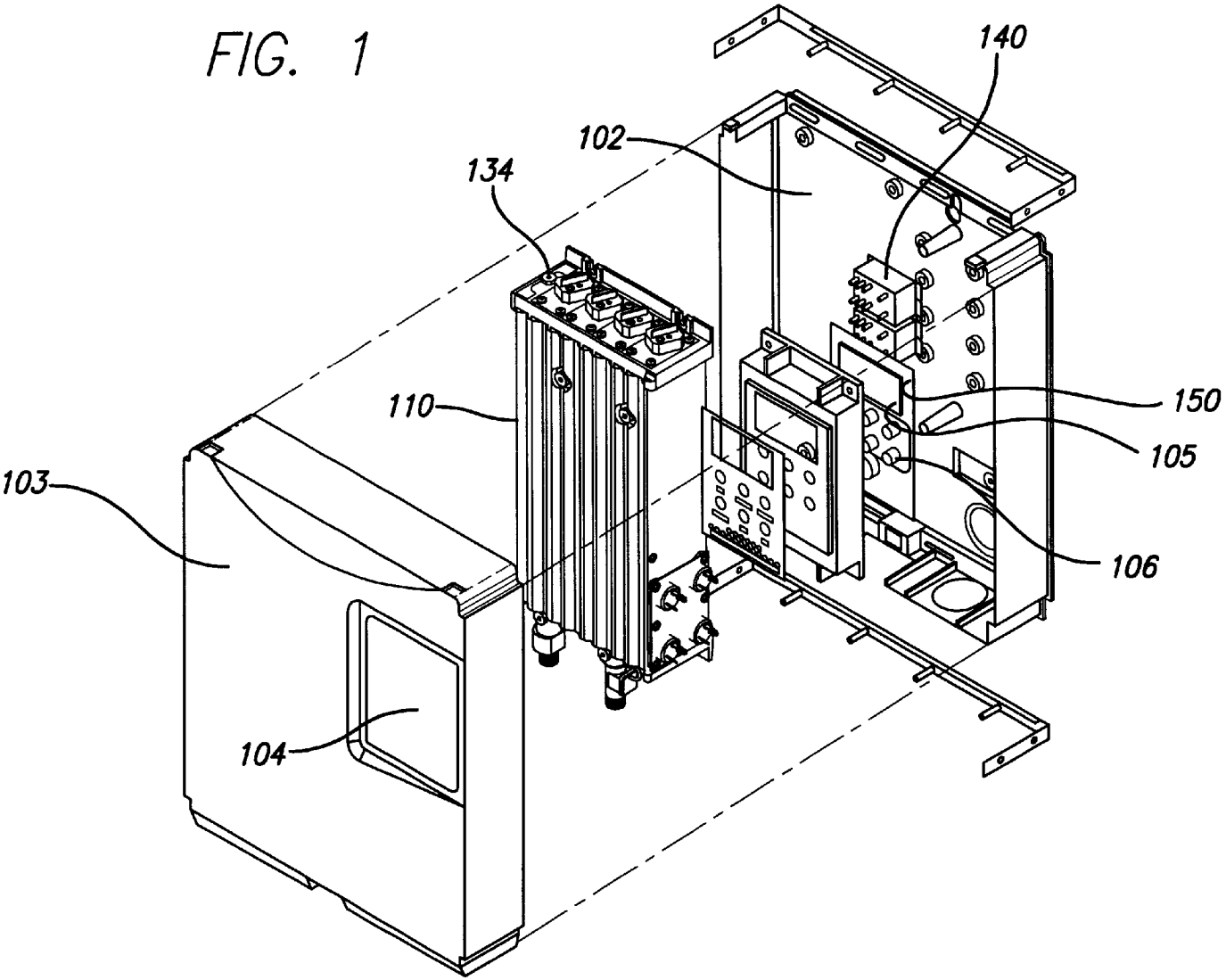
FIG. 1 is an exploded view of one embodiment of the invention.

The overall configuration of one embodiment of the invention is shown in FIG. 1. An external housing is configured to contain the apparatus and adapted to mount on a wall. Rear plate 102 attaches directly to the wall and mounts the other components. Front plate 103 serves as a cover and incorporates a window 104 for viewing the controls and settings. A microprocessor-based control module 105 allows setting of the desired temperature and functions to regulate the energization of the heating elements.

Figure 2:
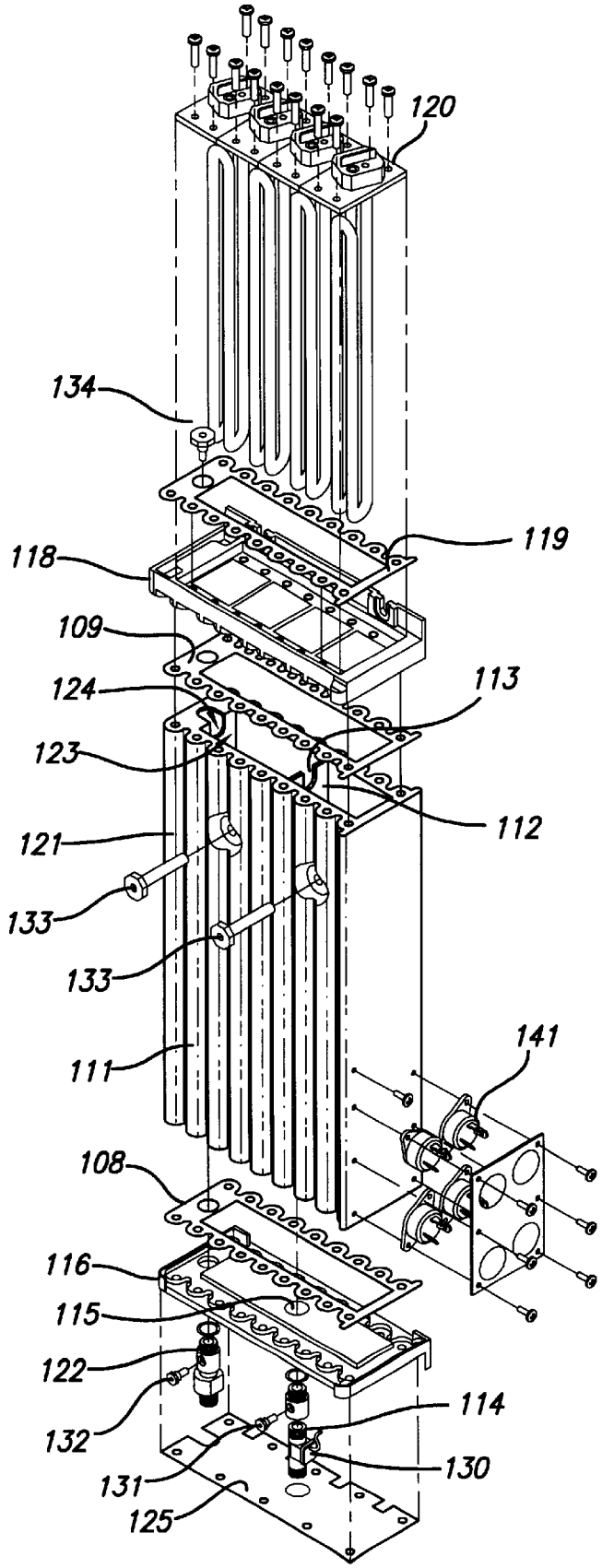
FIG. 2 is an exploded view of the heat transfer chamber.
Figure 3:
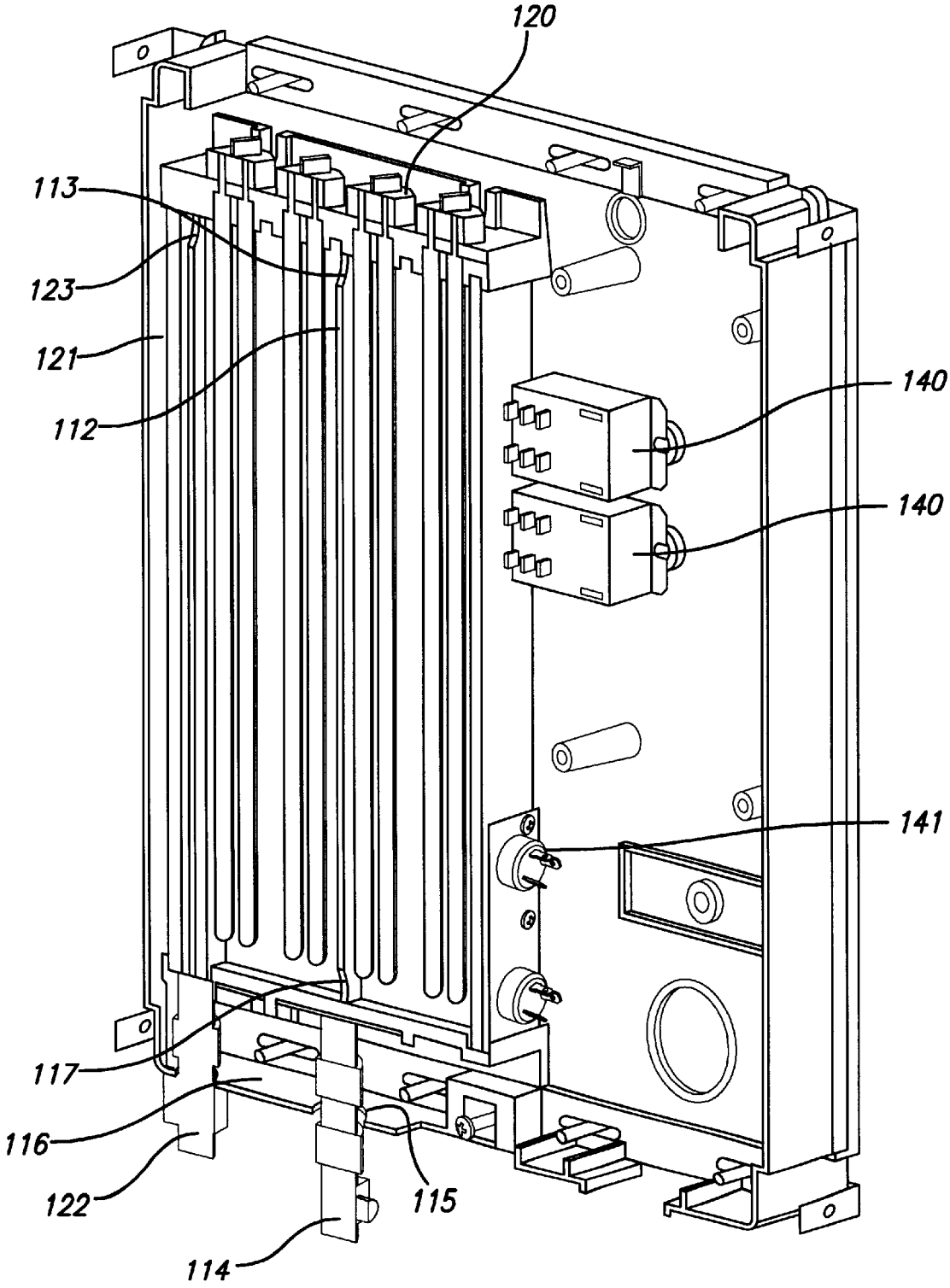
FIG. 3 is a cutaway view of the unit, showing the interior of the heat transfer chamber.

Heat transfer chamber 110 is seen in FIGS. 1, 2 and 3. It comprises a main housing 111 divided into subchambers by a rib support wall 112. A notch or u-shaped opening 113 at the top of the rib wall permits water to flow easily between the two sub-chambers. A similar notch 117 in the bottom of the rib wall facilitates water level balance between chambers. Water enters the heat transfer chamber through an inlet pipe 114, attached to a central aperture 115 in the bottom 116 of the chamber housing. In one embodiment, a metal plate 125 reinforces the bottom cap 116. The rib support wall 112 is centered over aperture 115. This causes the inflowing water under pressure to fill both subchambers at approximately the same time, reducing the chance of burnout of a heating element due to energization while dry.

The main housing 111 is preferably made from an aluminum alloy such as AL6036-T6. The aluminum enhances system safety by providing an electrical ground and also readily conducts heat across the chambers. The interior walls of the chamber should be coated with a material such as a fusion bonded epoxy, in order to retard corrosion and to maintain the water's potability. In one embodiment, the aluminum housing is powdercoated inside and out to achieve this result.

The unit may seat from one to four standard heating elements 120 in the heat chamber 110. One embodiment of the invention uses incoloy sheathed elements, but other heat sources known in the art may be employed. As illustrated in FIGS. 2 and 3, elements 120 fit snugly into the heat chamber 110. A flexible silicone gasket 109, preferably ethylene propylene dilene methylene, rests between the main housing and the chamber cap 118. A similar gasket 108 is placed between the main housing and the chamber bottom 116. Another similar gasket 119 fits atop the cap and receives the heating elements with a tight seal to withstand the expected pressures.

An exit chamber 121 located at one side of the main housing 111, is approximately the same size and shape as the plumbing that carries the hot water to its intended destination. An exit pipe 122 connects the exit chamber 121 to the plumbing. The wall 123 between the heat transfer chamber and the exit chamber is similar to the central rib wall 112 and has a u-shaped opening 124 at the top like that in the rib wall 113 This causes water under pressure in the heat transfer chamber to flow from the top to the bottom of the exit chamber and then out the exit pipe 122. By constructing the exit chamber integrally with the main housing and causing hot water to flow along the length of the heat transfer chamber, some radiant heat loss is mitigated.

The number of heating elements to be installed will depend upon the desired flow capacity. For low demand installations, a single heating element 120 might be satisfactory. This element would preferably be positioned nearest the exit chamber. An installation requiring more flow would require two elements next to each other in the subchamber adjacent to the exit chamber. A third element would preferably be placed in the other subchamber, nearest the dividing wall, and if four heating elements are called for, two will be set into each subchamber.

The heater unit includes a flow sensor to detect the volume of hot water being demanded by the user at any given time. In the preferred embodiment a standard turbine-type flow sensor 130 is placed in the inlet pipe 114 and connected to the control circuitry. Both the existence of demand and the actual volume per unit of time of water moving through the system are detected and transmitted to the control unit.

A temperature sensor 131, which may be a standard thermistor or another type of sensor, is placed in the water inlet line to measure and report the temperature of incoming water. A second temperature sensor 132, preferably of like type, is placed in the water outlet pipe 122. The preferred embodiment additionally includes a pair of temperature sensors 133, one located near the top of each heating subchamber. All of the temperature sensors provide input to the control circuitry.

A safety temperature sensor integrated with a thermal cut-off switch 134 having a manual reset button is placed at the top of the unit where heated water enters the exit chamber, 121. If water temperature exceeds a predetermined maximum indicative of system failure, the cut-off switch disables electricity flow to the entire unit and can be reset only after the temperature drops below the predetermined danger level.

A set of circuit relays 140 under software control provides an additional level of safety. Relay contacts are present in the electrical circuit for the installed heating elements 120. If temperature in one of the heating subchambers, as measured by the chamber temperature sensors 133 rises above a predetermined level, a signal will open the relay contacts in the circuits controlling the elements in the overheating chamber. The software-controlled cutoff will thus reduce the hazard before a mechanical shutoff becomes necessary.

The system controller is run by microprocessor 150. Based on the water flow, the measured temperature of incoming water, the desired set point and the measured temperature of outgoing water, the microprocessor uses standard methods to calculate the amount of energy necessary to elevate incoming water to the correct temperature. The microprocessor sends a signal to the Triacs, 141, each of which is connected to an element 120, causing the elements to energize.

Operation of the heater is under microprocessor control in a manner generally known in the art. Temperature sensor 131 at the water inlet and temperature sensor 132 at the water outlet feed data to the microprocessor, while flow sensor 130 provides flow rate to the microprocessor. A control program operates in a predetermined manner using rapidly repeated polling of sensors providing input temperature, output temperature, flow rate and a set point temperature which has been entered externally by the user via input buttons 106 or another device, to generate signals to TRIACS 141 associated with each heater element, thereby energizing the heater elements.

When the unit starts from a zero flow state, the microprocessor also reads the chamber temperature sensors 133 to determine the temperature of the residual water inside the unit and adjusts the energy levels accordingly. Constant monitoring of the critical parameters, i.e., flow rate, incoming water temperature and outgoing water temperature allows the microprocessor to control energy to the heating elements such that outgoing water temperature remains near the set point without substantial fluctuations.

It will be understood that various details of the invention may be changed without departing from the scope of the invention. The forgoing description is for the purpose of illustration only, and not for the purpose of limitation.

What is claimed is:

1. A tankless water heater comprising a main enclosed housing divided into a plurality of heating chambers separated by rib walls, each rib wall having a notched opening at a top side and at a bottom side to permit water flow between adjacent chambers;

said housing further including an exit chamber having a top side and a bottom side adjacent one of the heating chambers and separated therefrom by a rib wall having a notched opening at the top side;

an inlet aperture in a bottom surface of the housing, placed directly below one of the rib walls so that incoming water is distributed simultaneously into adjacent heating chambers;

at least one heating element placed in the heating chamber and connected by a circuit to a variable energy source;

means for measuring incoming water temperature and outgoing water temperature;

means for measuring water flow through the device;

and control means for activating the heating elements in response to the measured incoming and outgoing water temperature and flow rate to maintain a predetermined water temperature.

2. The device of claim 1 further including a plurality of temperature sensors, one being located in an upper portion of each heating chamber, connected to the control means.

3. The device of claim 1 further including a temperature sensor connected to a thermal cut-off switch which disables the power circuit to the device upon sensing a predetermined temperature level, and which switch may be manually reset.

4. The device of claim 2 further including a plurality of relays, one present in each circuit connecting a heating element to its associated power source, which relays are responsive to the control means and which may disrupt power to the respective heating element upon sensing of an overheating condition in the heating sub-chamber where the element is located.

5. The device of claim 1 wherein the control means is a microprocessor-based controller capable of manual temperature setting.

6. The device of claim 5 wherein the microprocessor based controller is capable of repeatedly calculating the energy needed to heat incoming water to maintain outgoing water temperature near a set point temperature based on a measured flow rate, measured incoming water temperature and measured outgoing water temperature, and is programmed to adjust the energy directed to the heating elements accordingly.

7. The device of claim 6 wherein the microprocessor based controller is capable of using temperatures measured by heating chamber temperature sensors to calculate the energy needed to produce outgoing water at the set point temperature.

8. A tankless water heater comprising a main enclosed housing divided into a plurality of heating chambers separated by rib walls, each rib wall having a notched opening at a top side and a bottom side to permit water flow between adjacent chambers;

said housing further including an exit chamber having a top side and a bottom side adjacent one of the heating chambers and separated therefrom by a rib wall having a notched opening at the top side;

an inlet aperture in a bottom surface of the housing, placed directly below one of the rib walls so that incoming water is distributed simultaneously into adjacent heating chambers;

at least one heating element placed in the heating chamber and connected by a circuit to a variable energy source;

means for measuring incoming water temperature and outgoing water temperature;

means for measuring water flow through the device;

control means for activating the heating elements in response to the measured incoming and outgoing water temperature and flow rate to maintain a predetermined water temperature;

a plurality of temperature sensors, one being located in an upper portion of each heating chamber, connected to the control means;

a plurality of relays, one present in each circuit connecting a heating element to its associated power source, which relays are responsive to the control means and which may disrupt power to the respective heating element upon sensing of an overheating condition in the heating sub-chamber where the element is located;

and a temperature sensor connected to a thermal cut-off switch which disables the power circuit to the device upon sensing a predetermined temperature level, and which switch may be manually reset.

* * * * *